US005822942A

United States Patent [19]

Lucia, Jr.

[11] Patent Number: 5,822,942

[45] Date of Patent: Oct. 20, 1998

[54] AUXILIARY SURFACE-FORMING MEMBER FOR CONSTRUCTION ELEMENTS

[76] Inventor: Nicholas J. Lucia, Jr., 65 Beverly Rd., West Caldwell, N.J. 07006

[21] Appl. No.: 799,942

[22] Filed: Feb. 14, 1997

Related U.S. Application Data

[63] Continuation of PCT/US95/10710, Aug. 15, 1995, and a continuation-in-part of Ser. No. 290,582, Aug. 15, 1994, abandoned.

[51] Int. Cl.[6] ..... E04G 23/04; E02D 37/00

[52] U.S. Cl. ..... 52/514; 52/241; 33/533; 33/645

[58] Field of Search ..... 52/241, 242, 730.7, 52/736.4, 737.5, 737.3, 721.5, 723.2, 731.5, 481.1, 127.2, 514; 33/562, 533, 645; 269/43, 910

[56] References Cited

U.S. PATENT DOCUMENTS 3,465,488 9/1969 Miller ..... 52/241

*Primary Examiner*—Christopher Kent

*Assistant Examiner*—Yvonne Horton-Richardson

*Attorney, Agent, or Firm*—Schweitzer Cornman Gross & Bondell LLP

[57] ABSTRACT

A device for forming a planar mounting surface in a chosen reference plane forward of one or more of structural members having a front face at least partially displaced rearwardly of said reference plane has a member (30) of extended length including a pair of legs (36, 38) supported by a perpendicular base portion (32). The legs define a pair of parallel faces spaced a distance corresponding to the width of the structural member (16') upon which the member is to be mounted. The base has an outward-lying flat planar face. The member is aligned on the structural member such that the outward-lying face is oriented and maintained along the reference plane, and the member is nailed or otherwise affixed to the structural member.

13 Claims, 4 Drawing Sheets

AUXILIARY SURFACE-FORMING MEMBER FOR CONSTRUCTION ELEMENTS

The present application is a continuation of PCT/US95/10710, filed Aug. 15, 1995, and is a continuation-in-part of U.S. patent application Ser. No. 08/290,582 Aug. 15, 1994.

The present invention relates to a device for use in the construction arts and in particular to a device having application in connection with the construction and renovation of structures having walls, floors or ceilings formed of panels affixed to frame members.

BACKGROUND OF THE INVENTION

Conventional construction techniques, especially in connection with the building of residential structures and the interior of commercial structures, include the creation of a framework of vertical studs which define walls for the structure. The studs are installed between horizontally-extending header and footer elements, and are typically spaced at regular intervals to accommodate the affixation of panels of sheet material, such as plywood or gypsumboard, against the studs to create the wall faces.

For proper placement of the panels, and to create an attractive, structurally sound wall, free of imperfections, it is important that the studs be aligned such that their front surfaces, to which the wall panel material are affixed, lie along a common plane and are straight and true. In addition, the placement of window and door openings in the walls require that wall framing around the openings such as door and window sills and jambs, must be straight and square to allow the door or window to be properly installed and subsequently operate smoothly.

Although the development of a perfectly flat and continuous plane by the studs and associated framing is desired, in practice such a condition cannot always be obtained. Studs may be installed incorrectly or inaccurately, or may have warpage and twists which cause them to depart from the proper and preferred orientation. Sills and jambs may be located inaccurately for the size door or window to be installed, or may be canted from the perpendicular to the studs. In addition, aging of the framing, resulting in shrinkage and distortion, as well as settling of the construction in which it is utilized, may result in subsequent misalignment, even if the structural elements were originally installed in a proper orientation. The removal of an original wall panel, such as during reconstruction or renovation, can remove the tension on the studs which kept them in alignment, allowing them to deform, and putting them and their associated framing out of alignment. Similar problems can arise in connection with floors and ceilings which utilize a framework of parallel members to which surface-creating members are affixed.

It is accordingly a purpose of the present invention to provide a method and device by which misalignment of studs, sills, jambs and other frame-type building elements can be corrected.

Another purpose of the present invention is to provide a method and device by which a reference plane can be developed with respect to a plurality of frame elements which themselves do not define such a plane whereby panels and similar elements can be installed upon the frame elements in a proper manner.

Yet a further purpose of the present invention is to provide a construction member alignment device which may be manufactured economically, and which may be easily and efficiently installed with conventional tools.

BRIEF DESCRIPTION OF THE INVENTION

In accordance with the above and other objects and purposes, the present invention encompasses a method and device by which a first reference plane may be developed across a matrix of construction elements, one or more of which do not have a face or surface lying in the plane. In a second embodiment, the invention encompasses a method and device whereby a series of intersecting reference planes may be aligned as desired with respect to each other to define a precisely-oriented opening in a wall construction. The plane-forming member may be embodied in a device which is mounted to a construction element requiring realignment or repositioning. Preferably, the device is of U-shaped cross-section, and may be formed in extended lengths, the legs of the device embracing the sides of the construction element. The base portion of the device has an integral rigid planar surface which is used to define a portion of the reference plane. The device is placed upon the portion of the construction element sought to be aligned or repositioned, and is plumbed or otherwise aligned such that its base portion lies along the reference plane. The mounting legs of the member are then affixed to the original structural element, the base of the member substituting for the forward face of the structural member for panel mounting purposes.

BRIEF DESCRIPTION OF THE DRAWINGS

A fuller understanding of the present invention may be obtained upon review of the following detailed disclosure of a preferred, but nonetheless illustrative embodiment of the present invention, when reviewed in connection with the annexed drawings, wherein.

DETAILED DESCRIPTION OF THE INVENTION

Figure 1:
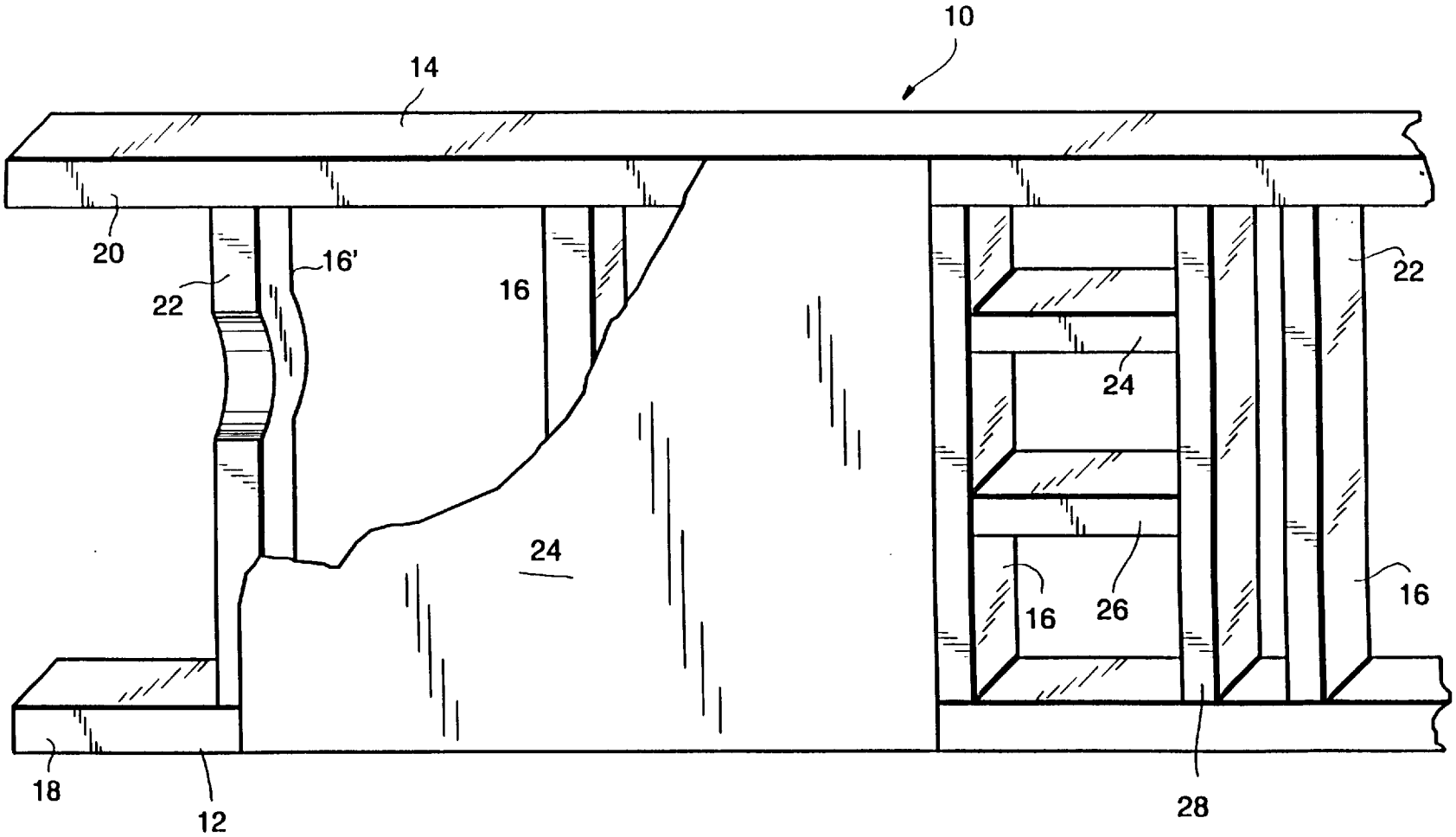
FIG. 1 is a representation of a typical portion of a wall construction depicting a defect capable of being cured by the present invention.

As shown in FIG. 1, a typical "stick construction" wall 10 includes a lower horizontal footer 12, an upper horizontal header 14, and a plurality of vertically extending studs 16 between the header and footer. It is intended that the outward-lying surfaces 18, 20 and 22 of the footer, header and studs respectively lie in and define a common vertical plane, allowing panels of a wall material 24, such as plywood or gypsumboard, to be mounted thereto. A similar construction can be utilized in floors and ceilings, when a series of horizontally-extending elements, floor joists or ceiling rafters, provide a reference mounting plane for the floor or ceiling material. As the studs 16 and the like are typically wood, they may exhibit a variety of imperfections and defects which make it difficult to develop the continuous, smooth plane important for proper wall panel installation. While the discussion which follows is directed to the correction of stud defects, it will be apparent that the present invention may be applied in a like manner to floors, ceilings and like structural members.

For example, as shown in FIG. 1, the stud 16' is warped, placing its front surface out of alignment with the other studs and preventing the overlying wall panel from resting thereon along the length of the stud. Such a defect can weaken the resulting wall. If the panel material is forced against the stud for fastening purposes, an unevenness in the resulting wall will result and, in extreme circumstances, can cause cracking of the panel material. Because of the ability of wood to react to changing moisture conditions, and further being subject to aging effects if not properly dried and seasoned prior to installation, warping, twisting and other defects may arise subsequent to construction, placing stresses upon the installed wall panels and leading to difficulties in renovation when the wall panels are removed and the studs are subsequently exposed for reuse.

In order to accommodate windows and doors, a rough frame for the window or door unit to be installed is created in the framing. Header and sill jambs 24, 26, respectively, define the height of the opening, while an additional stud 28, not on the regular spacing, typically 16 inches on center, defines the width of the opening. This rough opening is typically about 1 inch wider, and ½ inch higher than the door or window unit to be installed, the unit being aligned within the opening by the use of shims. While this spacing can be generally observed in new construction, the use of warped members, or imprecisely oriented elements, can provide an excessive spacing, making it difficult or impossible to properly shim the window or door into position.

In addition, during renovation, settling and aging can put the frame out of alignment, or create excessive spacing between the frame and unit to be installed. Further, the original dimension of the rough opening may be incompatible with a window or door unit to be installed in the opening.

Figure 2:
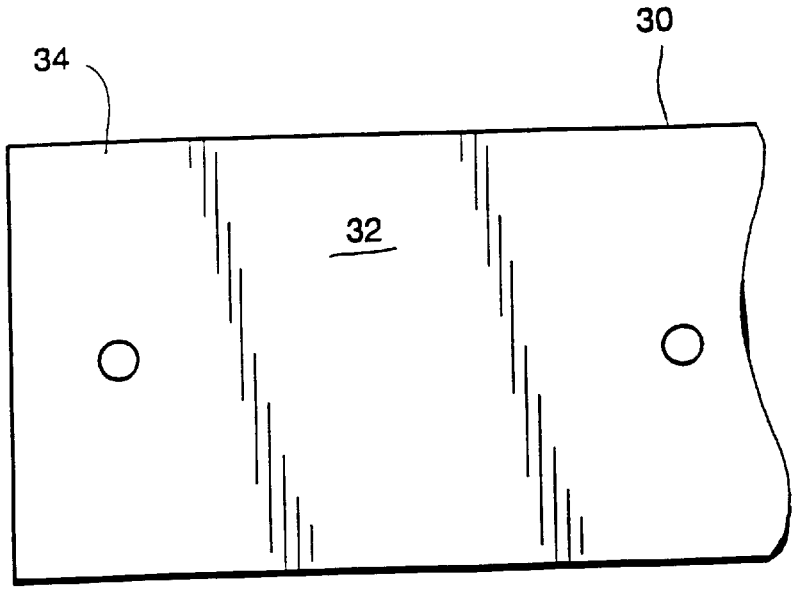
FIG. 2 is a front elevation view of the invention.
Figure 3:
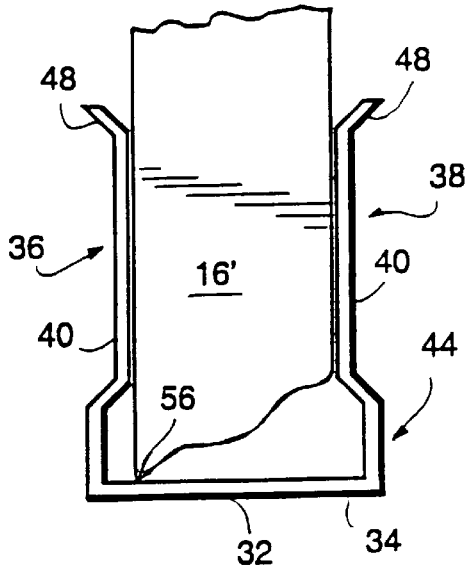
FIG. 3 is an end view of the invention as installed on a stud.
Figure 4:
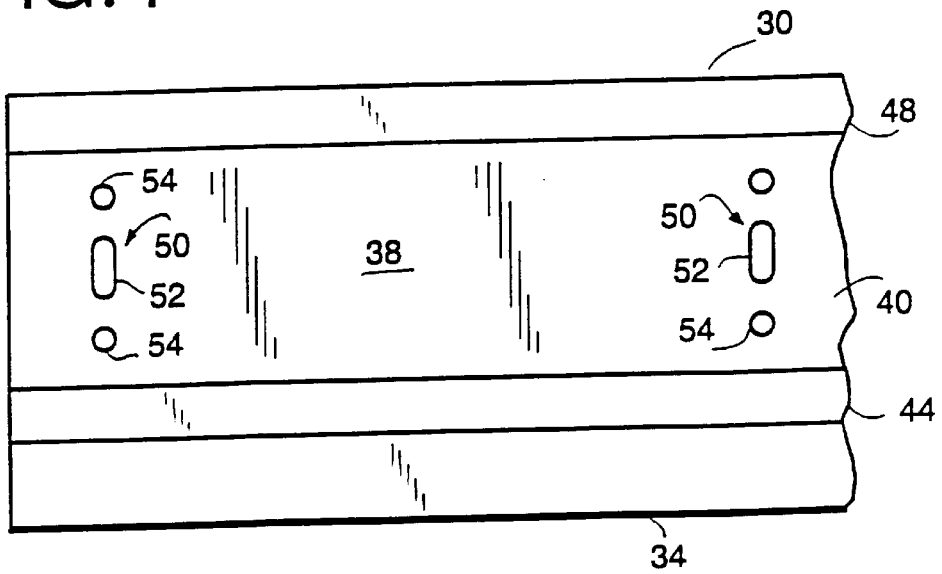
FIG. 4 is a side view of the invention.

In a first embodiment of the present invention, as shown in FIGS. 2–4, a smooth planar mounting surface may be developed across an expanse of wall defined by a plurality of studs by affixing to one or more of the studs the inventive device 30 which includes, as an integral part thereof, a reference plane-developing and defining surface 32 which replaces, for wall panel-mounting purposes, the front surface 22 of the stud to which the unit is mounted. As shown in the figures, the device 30 may take the form of a U-shaped element formed of aluminum, steel or similar material in which the plane-defining surface 32 is formed as the outwardly-lying face of main or base portion 34, which is bracketed by legs 36 and 38. The device may be preferably formed of galvanized steel, of between 0.020 and 0.030 inch thickness, the thicker material being used for devices intended for floor use.

As may be best seen in FIG. 3, the legs 36, 38 are preferably formed with a pair of main, parallel portions 40, 42, extending perpendicularly from the base 34, spaced apart from each other the width of the structural member or stud 16 with which the device is to be employed. In typical construction, studs are formed of "two-by" elements such as "two-by-fours", the first number referring to the nominal width in inches of the lumber. The actual width of the wood, however, is 1.75 inches, and accordingly the distance between the parallel leg portions 40, 42 is chosen to be that distance.

The width of the front, plane-defining surface 32 formed by the base 34 of the device is preferably slightly wider than the stud width. Accordingly, the base joins the main parallel sections 40 and 42 of the legs through angular leg transition portions 44, 46. Such a construction provides for leg flex, allowing the legs to accommodate variations and distortions in the member to which it is mounted. A preferred width for the base may be 1⅞".

In order to facilitate the installation of the device upon a stud, the distal ends of the legs 36, 38 are each provided with an outwardly-directed flare at 48. As seen in FIG. 4, each of the legs 36, 38 is provided with a plurality of spaced mounting means 50, as exemplified by the combination of a slot 52 and aligned bores 54. The sets of mounting means may be spaced, for example, 7½" apart along the length of the device. The leg depth may be approximately 2", which allows sufficient surface contact between the legs and the stud to which it is engaged, and permits adjustment of the positioning of the device for proper alignment.

As shown in FIG. 3, the reference plane for the wall material is at the forward corner 56 of the warped stud 16', whose front face extends angularly rearwardly from that point, making the stud unsuitable for wall panel mounting. The device 30 is installed on the stud and plumbed or aligned such that its base 34 lies along that plane. While there can be an offset in the actual positioning of the front face 32 due to the thickness of the base 34, such difference (0.020–0.030 inch) is insufficient to create any perceptible deviation from the reference plane.

It is to be appreciated that the depth of the legs 36, 38 allow engagement with the stud to be obtained notwithstanding its warped and curved character. With the device fully aligned, it is then fastened to the stud by use of appropriate fasteners, such as screws, through the mounting means 50 along the length of the device. By first utilizing the slots 52 prior to final alignment, the unit can be loosely mounted to the stud and repositioned into precise alignment with the reference plane, after which additional fasteners are driven through the bores 54.

Figure 5:
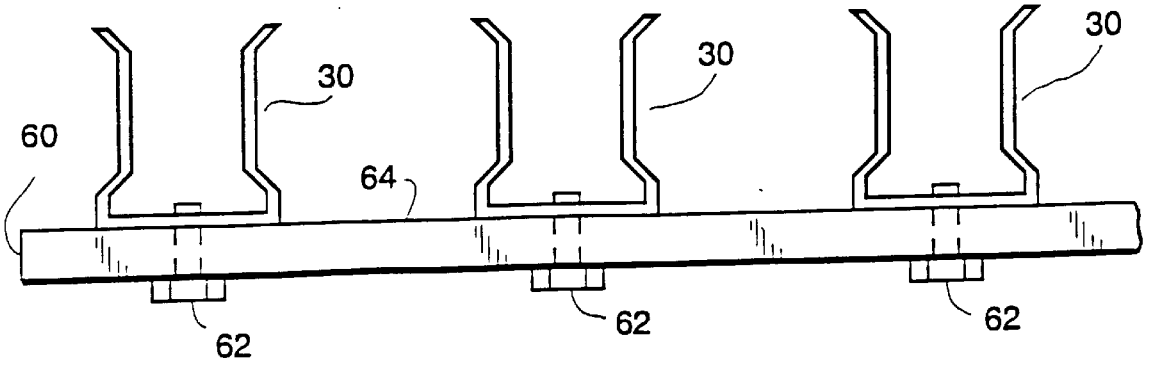
FIG. 5 is a top view of a plurality of units mounted to an installation tool.

The base 34 of the device may include threaded through-bores 58, typically positioned at the top, bottom, and middle of the device. When a plurality of stud faces need to be aligned, the required devices may be placed roughly in position on the respective studs and then joined together by a bar 60, as shown in FIG. 5, which is affixed to the units by the use of bolts 62 engaging the devices' respective through-bores 58. The front face 64 of the bar defines a common plane for the front surfaces of the abutting device bases 34 held thereto, and is aligned with the reference plane, allowing for the simultaneous alignment of the devices in the reference plane across the wall, irrespective of the positioning of the studs they engage. Once the devices 30 are aligned and fastened in position to their respective studs, the bolts 62 are withdrawn and the bar 60 is removed. The bar may be provided with one or more laterally-extending alignment slots through which the bolts 62 extend, and which allow the bolts, and thus the devices 30 to which they are threaded, to be positioned along the length of the bore to accommodate any variation in spacing for the studs before the devices are drawn snugly against the bar.

Figure 7:
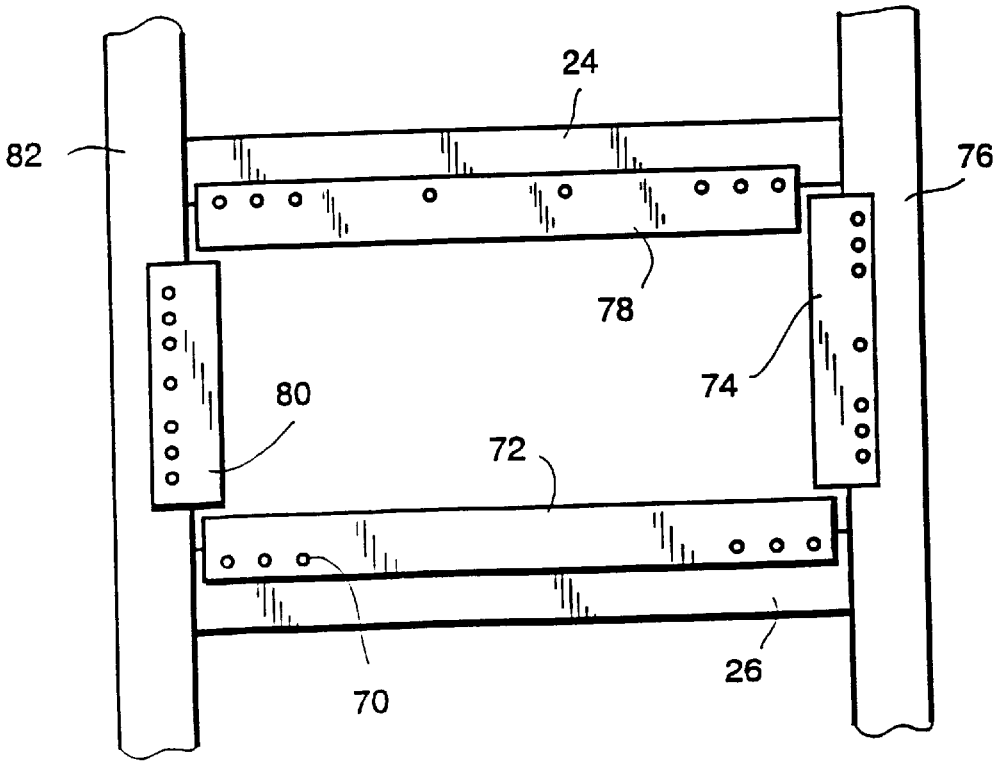
FIG. 7 is a front elevation view of the embodiment of FIG. 6 installed in a window frame.
Figure 6:
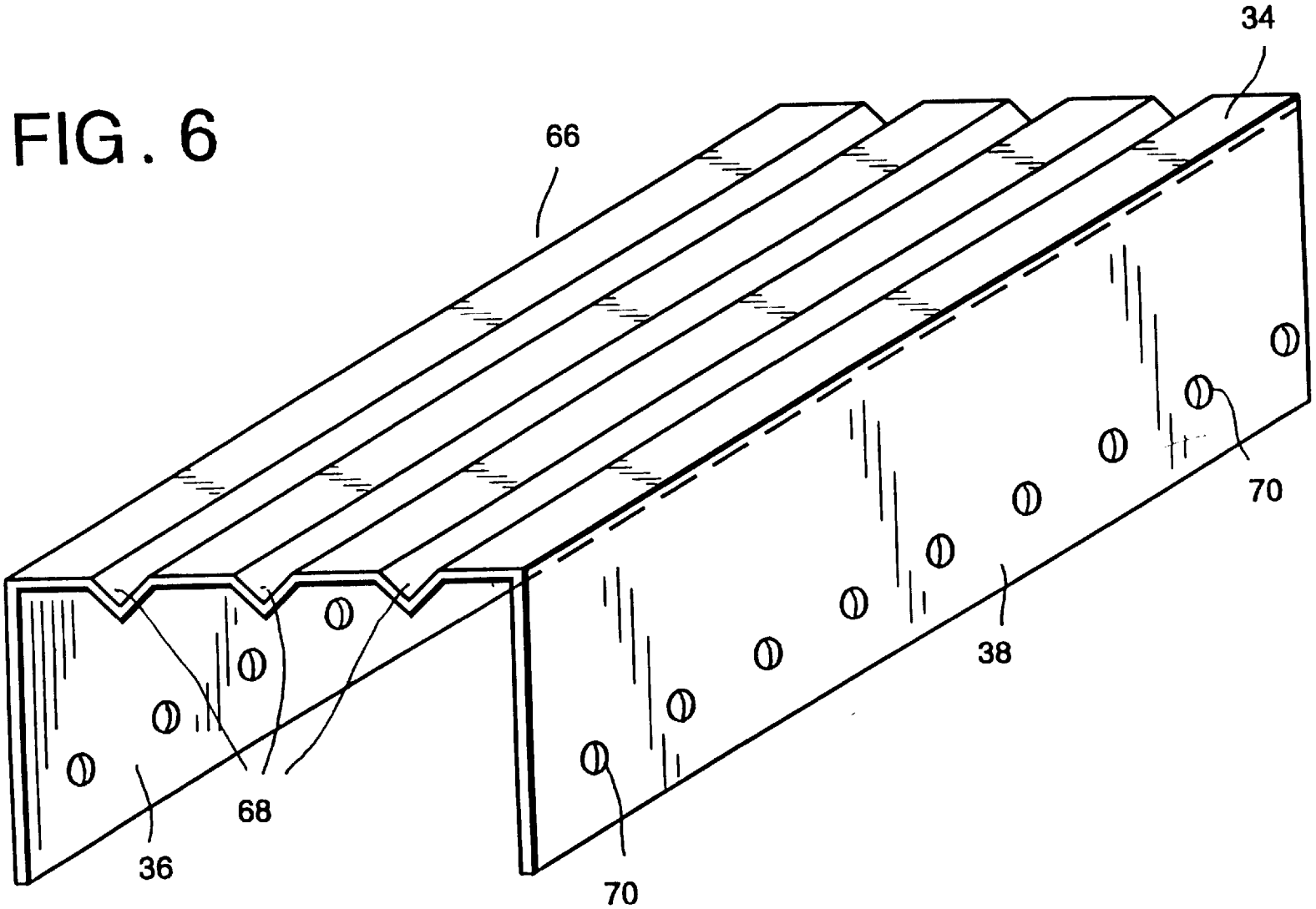
FIG. 6 is a perspective view of a second embodiment of the invention.

As depicted in FIGS. 6 and 7, a second embodiment 66 of the invention, intended to be utilized in connection with rough door or window openings or the like, maintains the general U-shaped construction of the invention, but includes a plurality of V-shaped grooves 68 extending the length of the main or base portion 34, which allow the width of the base portion to be adjusted to closely conform to width of the framing with which it is to be employed. The legs 36, 38 are preferably formed without the kink or bend found in the first embodiment. A series of mounting bores 70 extend along the legs for the length of the device. These bores are typically ⅜ inch from the free end of the leg. The embodiment may be preferably formed from 0.015 to 0.020 inch thick aluminum or galvanized steel.

Because the device is intended to be used at a point in construction or renovation where the wall framing has sheathing, a first wall surface material, applied, the width of the main body portion 34 is typically 4 3/16 inch for use with 2 by 4 stud construction. The height of the legs is 1½ inches.

As shown in FIG. 7, installation of the device in connection with a window opening as depicted in FIG. 7 is as follows: An extended length of sleeve device is cut to the length of one of the jambs, typically the sill 26. The cut length 72 is mounted on the sill, leveled and affixed in place using fasteners through the bores 70. A second length 74 is then cut to proper dimension and installed upon the right side stud 76 for the opening. The length is squared to the first length 72, placing the length deeply on the stud to keep the rough opening of maximum size.

Two additional lengths 78, 80 are cut, and placed on the remaining jamb, such as header 24, and the remaining stud 82 which define the opening. With reference to the window unit to be installed, measurements are taken of its height and width. The lengths 78, 80 can be precisely positioned as required to produce a receiving opening having the precise dimensions needed. Alternatively, the window unit can be placed in the opening, abutting against the affixed lengths 72 and 74. The lengths 78, 80 are then positioned to close the opening about the window and affixed into place.

It is to be appreciated that devices of the present invention can be fabricated in a variety of lengths to allow use, for example, over a portion, as well as an extended length, of a stud, and to accommodate window and door framing of various dimensions. In addition, while FIG. 3 depicts the device oriented on the stud whereby the back surface of the base 30 is in contact with the stud, it is to be readily appreciated that the device can be oriented on the stud such that the plane developed by the base is forward of any point on the stud. This provides additional utility, for example, when warpage of a stud results in its displacement out from the wall, while other studs remain straight or have warpage inward. A new reference plane, having no commonality with a stud face, can be provided by appropriate orientation of the devices. The depth of the legs 32, 34 allow a wide range of adjustment such that a common mounting surface can be identified and developed amongst a plurality of structural members having different orientations.

I claim:

1. A device for forming a planar mounting surface in a chosen plane corresponding to the desired position for a gypsum board panel or a similar construction element in a construction having at least one structural member to which the construction element is adapted to be affixed, said device comprising a member of extended length and an alignment tool upon which the member is mounted, said member having a pair of leg means supported by a base portion, said leg means defining a pair of faces spaced a distance corresponding to the width of the structural member upon which the device member is mounted and being adapted and arranged for aligning and supporting said device upon the structural member whereby said base lies along the chosen plane, said base comprising means for forming a portion of said planar mounting surface, for supporting the construction element thereupon and for allowing the rigid attachment of the construction element to said base.

2. A device for forming a planar mounting surface in a chosen plane corresponding to the desired position for the mounting of a gypsum board panel or similar construction element within a construction having at least one structural member to which the construction element is adapted to be affixed, said device comprising a member of extended length and an alignment tool upon which the member is mounted, said member having a pair of leg means supported by a base portion, said leg means defining a pair of faces spaced a distance corresponding to the width of the structural member upon which the device member is mounted and being adapted and arranged for aligning and supporting said device upon the structural member whereby said base lies along the chosen plane, said base comprising means for forming a portion of said planar mounting surface, for supporting the construction element thereupon and for allowing the rigid attachment of the construction element to said base; means for allowing the fixed mounting of said device upon said structural member whereby said base is permanently maintained along said chosen plane, and means located on said base for mounting said member upon said tool.

3. The device of claim 2, wherein said means for removably mounting said member upon the alignment tool comprises a threaded throughbore in said base portion adapted to accept a bolt projecting from said alignment tool.

4. The device of claim 2 wherein said alignment tool is adapted to accept a plurality of members.

5. The device of claim 4 wherein said tool comprises a bar having a planar face upon which the base portions of said members are mounted.

6. The device of claim 5 wherein said tool planar face includes means for varying the position of the members mounted thereon.

7. The device of claim 6 wherein said varying means comprise a series of slots dimensioned to accept said bolt.

8. The device of claim 2, wherein the width of said base is greater than the distance between said parallel faces of said legs, said legs further comprising a flexible portion joining said parallel faces to said base.

9. The device of claim 8, wherein said means for allowing the fixed mounting of said member comprise a series of sets of nail and screw-accepting apertures through said parallel faces.

10. The device of claim 9, wherein each of said aperture sets include a slot and a bore.

11. A method for forming a planar mounting surface along a chosen reference plane along which at least one construction element is to be located, said mounting surface being displaced in a first direction from commonly oriented faces of one or more structural members, comprising the steps of:

identifying each of said structural members;

mounting a member of extended length and having a base portion with a flat planar face and a pair of parallel legs for engaging a structural member upon each identified structural member in a manner whereby said legs embrace the sides of the structural member and support the member thereon;

defining and establishing said reference plane with respect to said commonly oriented faces of the identified structural members;

aligning said flat planar face of each of said member along said reference plane;

affixing said legs to said structural member sides to maintain said flat planar face along said reference plane; and mounting said at least one construction element to the planar faces of the affixed members.

12. A method for forming an installation aperture in a structure having an existing aperture formed of structural members and of a size greater than the desired installation aperture, the installation aperture being located within the periphery of the existing aperture, comprising the steps of:

mounting a first member of a length corresponding to a first dimension of the installation aperture and having a base portion and a pair of parallel legs extending from said base upon a first one of the structural members forming the existing aperture dimension upon which the first member is adapted to be mounted in a manner whereby said legs embrace the sides of the structural member and support the member thereon;

defining and establishing a first reference plane for said base of said first member corresponding to the position of the corresponding side of the installation aperture and aligning said base along said reference plane;

affixing said legs to said first structural member to maintain said face along said reference plane; and repeating said mounting steps with additional member lengths upon the remaining structural members forming the existing aperture in a manner whereby the base members of said member lengths define sides of the desired installation aperture.

13. A method for forming a planar mounting surface along a chosen reference plane along which at least one construction element is adapted to be located, said mounting surface being displaced in a first direction from commonly oriented faces of one or more structural members, comprising the steps of:

identifying each of said structural members;

mounting a member of extended length and having a base portion with a flat planar face and a pair of parallel legs for engaging each identified structural member in a manner whereby said legs embrace the sides of the structural member and support the member thereon;

defining and establishing said reference plane with respect to said commonly oriented faces of the identified structural members;

aligning said flat planar face of each of said member along said reference plane;

affixing said legs to said structural member sides to maintain said flat planar face along said reference plane; and mounting said at least one construction element to the planar faces of the affixed members, wherein the step of mounting a member upon each identified member comprises a preliminary step of mounting the base of each of the members to a common planar surface of an alignment tool, said step of aligning the planar faces of the members comprises the step of orienting the planar surface of the tool along said reference plane, and the step of affixing said legs to the structural member sides is followed by a step of unmounting the members from the alignment tool.

* * * * *